US007562531B2

(12) United States Patent
Falavigna et al.

(10) Patent No.: US 7,562,531 B2
(45) Date of Patent: Jul. 21, 2009

(54) METHOD AND SYSTEM FOR OPERATIVE RECONVERSION OF PAIRS OF PRE-EXISTING STEAM TURBO-UNITS

(75) Inventors: Loris Falavigna, Genoa (IT); Alberto Torre, Genoa (IT)

(73) Assignee: Ansaldo Energia S.p.A., Genoa (IT)

( * ) Notice: Subject to any disclaimer, the term of this patent is extended or adjusted under 35 U.S.C. 154(b) by 423 days.

(21) Appl. No.: 11/495,782

(22) Filed: Jul. 31, 2006

(65) Prior Publication Data

US 2007/0028616 A1 Feb. 8, 2007

(30) Foreign Application Priority Data

Jul. 29, 2005 (EP) ..... 05425563

(51) Int. Cl.
*F01K 7/22* (2006.01)

(52) U.S. Cl. ..... 60/653; 60/679

(58) Field of Classification Search ..... 60/653, 60/677–680

See application file for complete search history.

(56) References Cited

U.S. PATENT DOCUMENTS 2,955,429 A * 10/1960 Miller ..... 60/679
3,073,964 A 1/1963 Csanady, Jr.
3,623,324 A 11/1971 Eggenberger
4,015,430 A * 4/1977 Braytenbah et al. ..... 376/211
5,649,416 A 7/1997 Moore et al.
7,040,095 B1 * 5/2006 Lang ..... 60/653

FOREIGN PATENT DOCUMENTS

NL 247 242 A 2/1964

OTHER PUBLICATIONS

Patent Abstracts of Japan, vol. 008, No. 087, "Cross Compound Type Steam Turbine", 2 pages, (Apr. 20, 1984).

* cited by examiner

*Primary Examiner*—Hoang M Nguyen
(74) *Attorney, Agent, or Firm*—Sughrue Mion, PLLC

(57) ABSTRACT

Method and system, in which a pair of pre-existing steam turbo-units, a first one of which is formed by a first steam turbine and a first electric generator connected on a first common shaft and a second one of which is formed by a second steam turbine and by a second electric generator connected on a second common shaft, are coupled to one another in a system configuration of a cross-compound type; in which high-pressure and medium-pressure sections of the first turbine are replaced with a single high-pressure section made in such a way as to maintain the pre-existing foundations, and in which high-pressure and medium-pressure sections of the second turbine are replaced with a single medium-pressure section made in such a way as to maintain the pre-existing foundations. A single supercritical boiler supplies in cascaded fashion one and the same flow of steam to the new high-pressure and medium-pressure sections set on the first shaft and on the second shaft, respectively. A single piping downstream of the new medium-pressure section collects the flow of steam and supplies it in parallel, via a branch thereof intercepted by a regulation valve, to the pre-existing low-pressure sections of both of the shafts.

9 Claims, 1 Drawing Sheet

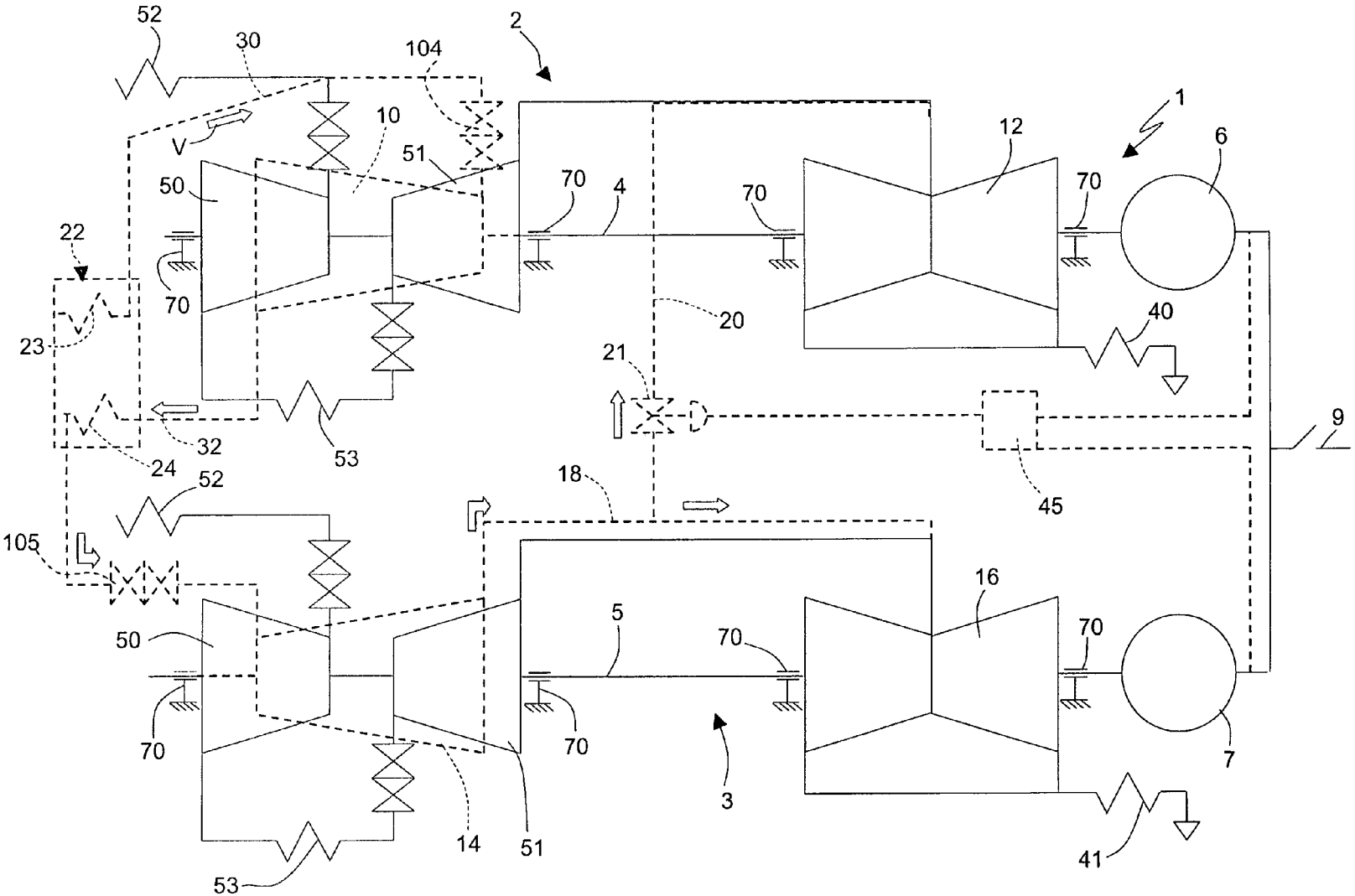
1
2
3
4
5
6
7
9
10
12
14
16
18
20
21
22
23
24
30
32
40
41
45
50
51
52
53
70
104
105
V

METHOD AND SYSTEM FOR OPERATIVE RECONVERSION OF PAIRS OF PRE-EXISTING STEAM TURBO-UNITS

The present invention relates to a method for obtaining operative reconversion of pairs of pre-existing steam turbo-units. The invention moreover relates to a system for the production of energy by means of at least one pair of steam turbines operating in the so-called cross-compound configuration, i.e., in which each turbine is set on a separate shaft and operates a generator of its own.

BACKGROUND OF THE INVENTION

It is known that numerous systems for the generation of energy are based upon a pair of turbo-units operating in tandem-compound configuration, in which each turbo-unit includes an electric generator driven on the same shaft by a steam turbine supplied by an oil-burning or coal-burning boiler of its own, with subcritical steam conditions both on superheated (SH) steam for high-pressure (HP) admission and on re-superheated (RH) steam for medium-pressure (MP) admission. Steam turbines are generally of the two-body type (a combined HP-MP section and a low-pressure (LP) section).

The above type of systems presents a relatively low efficiency, so that the tendency is to convert such a system into a system of approximately the same power, which presents supercritical and/or ultrasupercritical conditions at HP and MP admission (in order to increase the efficiency) and is based upon a single boiler, which supplies both of the pre-existing turbines, reconfigured into a cross-compound configuration.

For the above purpose, the known art envisages, in addition to replacing the two boilers with a new boiler of approximately twice the horsepower, replacement of the two steam turbines or of at least the two combined HP-MP sections with as many new sections in order to meet up to the higher design conditions (pressure and temperature of the steam at admission to the HP and MP sections), for which the materials and the original design of the pre-existing turbines are no longer adequate.

Said solution is not, however, free from drawbacks. In addition to being costly, the new steam-turbine sections present, in fact, levels of efficiency that are panalized, as compared to the new supercritical or ultrasupercritical steam conditions, by the number of stages limited by the encumbrance of the existing foundation.

With a single boiler, which supplies the two turbo-units, the system of regulation and the running of the turbo-units themselves together represents, then, an element of greater complexity. It is, in fact, necessary to provide manifolds for the SH and RH steam, from which both of the turbo-units are to be supplied in branched fashion, and it is problematical to adapt the steam conditions to the requirements of the two turbo-units (which may be different from one another, for example, with one unit in use and the other unit in its starting up stage after a stoppage). For instance, it is necessary to double, among other things, the total number of the main valves and the number of the regulation and protection systems.

Systems in cross-compound configuration with different lay-outs are also known to the art, for example from U.S. Pat. No. 4,316,362 and JPA59-60008. The configurations known from said documents are, however, suitable only for newly-devised systems, and not for reconfiguration of pre-existing systems. Furthermore, the systems known from said documents present complex lay-outs.

SUMMARY OF THE INVENTION

The aim of the present invention is to provide a method for enabling conversion of a traditional thermoelectric system fed by a subcritical steam cycle and based upon a pair of steam turbo-units of similar size into a single turbo-units group in cross-compound configuration with approximately twice the power, that will be free from the drawbacks described and that, in particular, will enable the necessary adaptation of the steam turbo-units present to be obtained with relatively reduced investments, in short times, in a simple way and at the same time achieving high levels of energy efficiency.

A further aim of the invention is to provide a system for the production of energy that will be simple and inexpensive to set up, in particular in the case of reconversion of a pre-existing system based upon a traditional subcritical steam cycle into a supercritical system, which will be highly reliable and relatively simple to control.

According to the invention, a method for obtaining operative reconversion of pairs of pre-existing steam turbo-units is hence provided according to what is defined in the attached claims.

According to the invention, a system for the production of energy by means of at least one pair of steam turbines operating in cross-compound configuration is moreover provided according to what is defined in the attached claims.

In particular, in the system according to the invention, a first steam turbine is coupled on a first shaft to a first electric generator, and a second steam turbine is coupled on a second shaft to a second electric generator. The first steam turbine includes just a high-pressure section and a first low-pressure section, whereas the second steam turbine includes just a medium-pressure section and a second low-pressure section.

The high-pressure section is connected exclusively to the medium-pressure section, upstream thereof, whilst the medium-pressure section is connected in parallel to said first and second low-pressure sections, immediately upstream thereof, by means of a piping of a relatively short length, which connects the medium-pressure section of the second steam turbine to the second low-pressure section, which is located on the same shaft, and, by means of a branching of said piping, of a relatively long length, which connects said medium-pressure section to the first low-pressure section, which is located on the shaft of said high-pressure section.

A regulation valve intercepts said branch in series, as close as possible to said piping.

Hereinafter, by the term "hydraulically connected" is meant a connection that enables a fluid (indifferently, liquid or, as in the present case, gas, i.e., in form of steam) to flow between the connected elements. Likewise, as may be seen, the terms "upstream" and "downstream" are referred to the direction of flow of said fluid.

One such system is obtained with the method of the invention, which comprises: a step of decommissioning and removal of the high-pressure and medium-pressure sections of both of said steam turbines; a step of replacement of the removed sections with a new high-pressure section on the first shaft and a new medium-pressure section on the second shaft, said new high-pressure section and medium-pressure section being made in such a way as to occupy at least part of the space left free, on each shaft, by both the high-pressure section and medium-pressure section removed from that shaft, leaving the pre-existing foundations unaltered; and a step of setting in hydraulic connection in cascaded fashion the new high-pressure section on the first shaft and of the new medium-pressure section on the second shaft with a single supercritical boiler, in such a way that the latter will be able to supply one and the same flow of steam, in series, to the new high-pressure section and, then, to the new medium-pressure section.

The advantages as compared to the known art are the following:

- the new sections of turbine (an HP body replacing the HP-MP body of the first shaft and an MP body replacing the HP-MP body of the second shaft) enable optimized levels of efficiency of the individual sections to be achieved on account of the reduction in the secondary losses (larger dimensions of the blade); and
- the new cross-compound turbo-unit group of twice the power as compared to the two turbo-units according to the known art will have construction and management costs of that are considerable lower, owing to the smaller number of components (the number of the main valves and of the regulation and protection systems is reduced to one half).

Finally, the system and the method according to the invention enable control of the system to be carried out in a simplified way, controlling with sufficient precision the speed of the two shafts via the regulation valve set in series along the branch. In particular, it is possible to limit the overspeed of the corresponding line of shafts in the case of total loss of the electrical load or, in any case, to satisfy in operation any possible requirements of regulation of the flowrate towards said section. Thus the known problem linked to the considerable amount of steam contained in the line having non-controllable flowrate, which might cause situations that are dangerous for the mechanical integrity of the line of shafts itself, is overcome.

Finally, it is possible to apply the solution proposed on systems with the two lines of shafts set even at a considerable relative distance apart from one another, something which is not possible with the cross-compound configurations of the known art.

BRIEF DESCRIPTION OF THE DRAWING

Further purposes and advantages of the invention will emerge clearly from the following description of an embodiment thereof, provided purely by way of non-limiting example and with reference to the FIGURE of the annexed plate of drawings, which is a schematic illustration of a system for the production of energy in cross-compound configuration on two shafts.

DETAILED DESCRIPTION OF THE INVENTION

With reference to the aforesaid single FIGURE, designated as a whole by 1 is a system for the production of electrical energy by means of at least one pair of steam turbines 2, 3 of similar size, operating in cross-compound configuration. In particular, the system 1 comprises a first steam turbine 2, which is coupled on a first shaft 4 to a first electric generator 6, and a second steam turbine 3, which is coupled on a second shaft 5 to a second electric generator 7. The generators 6, 7 are then connected in a way that is known and in any case obvious to persons skilled in the art, to an electrical network 9.

The steam turbine 2 includes just one high-pressure section 10 and one first low-pressure section 12, whilst the steam turbine 3 includes just one medium-pressure section 14 and one second low-pressure section 16.

The high-pressure section 10 is exclusively connected, according to an aspect of the invention, to the medium-pressure section 14, located on the other shaft (the section 10 is on the shaft 4, whilst the section 14 is on the shaft 5), upstream thereof, whilst the medium-pressure section 14 is connected in parallel to both the first low-pressure section 12 and the second low-pressure section 16, immediately upstream thereof.

Hereinafter, the terms "upstream" and "downstream" refer to the direction of flow of the operating fluid (steam) in the system 1, indicated schematically by the arrows in the FIGURE.

In particular, the medium-pressure section 14 is connected to the low-pressure sections 12 and 16 by means of a piping 18 of a relatively short length, which connects the medium-pressure section 14 directly to the low-pressure section 16, which is located on the same shaft 5, and by means of a branch 20 of the piping 18, of a relatively long length, which connects the piping 18 to the low-pressure section 12, which is located on the shaft 4 provided with the high-pressure section 10.

A regulation valve 21 intercepts in series the branch 20, as near as possible to the piping 18.

The system 1 further comprises a single supercritical boiler 22, which supplies in cascaded fashion the high-pressure section 10 and, then, the medium-pressure section 14. The boiler 22 for the production of steam in turn comprises at least one superheater element 23 and at least one re-superheater element 24, constituted by nests of pipes arranged within a single casing to form the boiler 22. A first branch 30 of hydraulic circuit connects the superheater 23 to the high-pressure section 10 of the steam turbine 2. A second branch 32 of hydraulic circuit connects the high-pressure section 10 to the medium-pressure section 14 of the steam turbine 3. The re-superheater 24 is hydraulically inserted in series along said branch 32.

The low-pressure sections 12 and 16 discharge the exhaust steam towards condensers 40 and 41, respectively. The valve 21 can be, as may be seen, an on-off valve, or else a proportional valve; in any case, it is controlled by an electronic control unit 45 for controlling rotation of the shafts 4 and 5. The electronic control unit 45, indicated schematically as a block in the FIGURE, is in actual fact a complex system (which is on the other hand known or in any case of a type obvious for a person skilled in the art and consequently is not described in detail herein) for regulation/protection that controls also the new main valves of the HP and MP sections (indicated in the FIGURE as dashed and identified by the reference numbers 104 and 105, respectively) and not only rotation of the shafts; it moreover controls also (and not only) the pressure of the steam.

According to the method of the invention, the system 1 is obtained by operative reconversion of a pair of pre-existing steam turbo-units of similar size, such as for example the two units constituted respectively by the turbine 2, with the shaft 4 and the generator 6, and by the turbine 3 with the shaft 5 and the generator 7, which are coupled to one another in an innovative configuration of a cross-compound type. In this case, both of the pre-existing turbines 2 and 3 comprise, instead of the single sections 10 and 14, normal HP-MP units; i.e., each comprises a high-pressure section 50 and a medium-pressure section 51, and each is supplied originally by an independent subcritical boiler provided with a superheater 52 and a re-superheater 53.

The method of the invention then comprises: a step of decommissioning and removal of the high-pressure and medium-pressure sections 50, 51 of both of the steam turbines 2 and 3; and a step of replacement of the removed sections 50, 51 with a new high-pressure section 10 on the first shaft 4 and with a new medium-pressure section 14 on the second shaft 5.

According to the invention, however, said new high-pressure section 10 and new medium-pressure section 14 are made in such a way as to occupy at least (a fair) portion of the space left free, on each shaft 4, 5, by both the high-pressure and medium-pressure sections 50, 51 removed from that shaft, leaving the respective pre-existing foundations 70 of each shaft 4, 5 unaltered.

The method of the invention further envisages a step of setting in hydraulic connection in cascaded fashion the new high-pressure section 10 on the first shaft 4 and the new medium-pressure section 14 on the second shaft 5 with a single supercritical boiler 22, so that the latter will be able to supply one and the same flow of steam V (indicated by the arrow), in series, to the new high-pressure section 10 and, then, to the new medium-pressure section 14.

The method according to the invention further envisages a step of setting in hydraulic connection in parallel exclusively the new medium-pressure section 14 with the respective pre-existing low-pressure sections 12, 16 of both of the turbines 2 and 3, set respectively on the first shaft 4 and on the second shaft 5, by means of the single piping 18 set downstream of the new medium-pressure section 14 to collect substantially the entire flow of steam V that traverses the latter and supply it in parallel, directly, to the pre-existing low-pressure section 16 of the second shaft 5 and, via the branch 20 intercepted by the regulation valve 21, to the pre-existing low-pressure section 12 of the first shaft 4.

Obviously, the method of the invention envisages also a step of removal of the respective subcritical boilers for actuation of the first and second turbines 2, 3 (hence with removal of the superheaters and re-superheaters 52, 53) and installation of the single supercritical boiler 22 for actuation of both of the turbines 2, 3.

The single supercritical boiler 22 is provided with at least the superheater 23 and the re-superheater 24, cascaded to one another, the former hydraulically connected in series to the new high-pressure section 10 of the first shaft 5 upstream thereof, and the latter hydraulically connected in series to the new medium-pressure section 14 of the second shaft 5, immediately upstream thereof and immediately downstream of the new high-pressure section 10.

The regulation valve 21 is set on the branch 20 as near as possible to the piping 18 that connects the branch 20 and the pre-existing low-pressure section 16 of the second shaft 5 to the new medium-pressure section 14 of the second shaft 5 itself. The regulation valve 21 can be, as has already been said, an on-off valve, or else a proportional valve controlled by the electronic control unit 45, programmed to perform, in a way that is known to a person skilled in the art, functions of control and protection for both the first shaft 4 and second shaft 5, as has been more fully specified previously.

From the foregoing description, it is evident how the solution of replacing on pre-existing turbines the traditional units of high-pressure and medium-pressure sections with single high-pressure or medium-pressure sections (one on one shaft and the other on the other shaft) of substantially the same overall dimensions, enables ready adaptation of the regulation of the cross-compound turbo-unit and of the electrical part of the generators, with similar powers on the two generators. It will simply be necessary to have:

1—a mechanical and vibrational re-design of the two lines of shafts, constituted each by a set of new parts and existing parts to enable their operation in normal and emergency conditions;

2—a new design of the pipes that connect the single MP section to the two existing LP sections; in particular, on the line downstream of the branching towards the LP section most distant from the new MP section, there is envisaged insertion of the valve 21, for example with automatic control, which:

A) enables limitation of the overspeed of the corresponding line of shafts in the case of total loss of the electrical load, or in any case makes it possible to satisfy in operation any possible requirements of regulation of the flowrate towards said section;

B) enables, also for the reasons explained above in point A), application of the proposed solution on systems with the two lines of shafts at a considerable relative distance apart;

3—maintenance of existing foundations, generators, LP sections and condensers;

4—a new and single control and protection system for both of the shafts of the turbine, such as to enable, on the basis of the new re-designing mentioned in the previous points, with particular reference to the protections corresponding to the overspeed;

5—a new design of the instrumentation and of the monitoring of the two existing units to enable regular operation thereof as a single unit; and 6—a re-design of the electrical part to enable operation of the two generators (envisaged for independent operation) as a single unit (generation in parallel).

The invention claimed is:

1. A method for obtaining operative reconversion of a pair of pre-existing steam turbo-units, in which at least one pair of said steam turbo-units, a first of which comprising a first steam turbine (2) and a first electric generator (6) connected on a first common shaft (4) and a second of which comprising a second steam turbine (3) and a second electric generator (7) connected on a second common shaft (5), are coupled to one another in a configuration of a cross-compound type; said method being characterized in that it comprises at least:

a step of decommissioning and removal of the high-pressure and medium-pressure sections of both of said steam turbines;

a step of replacement of the removed sections with a new high-pressure section (10) on the first shaft and a new medium-pressure section (14) on the second shaft, said new high-pressure and medium-pressure sections being made in such a way as to occupy at least part of the space left free, on each shaft, by both the high-pressure section and the medium-pressure section removed from that shaft, leaving the pre-existing foundations unaltered; and a step of setting in hydraulic connection in cascaded fashion the new high-pressure section on the first shaft and the new medium-pressure section on the second shaft to a single supercritical boiler (22), in such a way that the latter will be able to supply one and the same flow of steam, in series, to the new high-pressure section and, then, to the new medium-pressure section.

2. The method according to claim 1, characterized in that it further comprises a step of setting in hydraulic connection in parallel only the new medium-pressure section with respective pre-existing low-pressure sections (12, 16) of both said first turbine and said second turbine, set respectively on the first shaft and on the second shaft, by means of a single pipe (18) set downstream of the new medium-pressure section to collect substantially all the flow of steam (V) that traverses the latter and supply it in parallel, directly, to the pre-existing low-pressure section (16) of the second shaft and, via a branch (20) intercepted by a regulation valve (21), to the pre-existing low-pressure section of the first shaft.

3. The method according to claim 1, characterized in that it comprises a step of removal of respective subcritical boilers, of actuation of said first and second turbines, and of installation of a single said supercritical boiler for actuation of both of the turbines.

4. The method according to claim 3, characterized in that said single supercritical boiler is provided with at least one superheater (23) and at least one re-superheater (24), cascaded to one another; the former being hydraulically connected in series to said new high-pressure section of the first shaft upstream thereof and the latter being hydraulically connected in series to said new medium-pressure section of the second shaft, immediately upstream thereof and immediately downstream of the new high-pressure section.

5. The method according to claim 2, characterized in that said regulation valve (21) is set on the branch as close as possible to the pipe that connects the branch and the pre-existing low-pressure section of the second shaft to the new medium-pressure section of the second shaft.

6. The method according to claim 5, characterized in that said regulation valve is an on-off valve.

7. The method according to claim 5, characterized in that said regulation valve is a proportional valve controlled by an electronic control and protection unit (45) for both said first shaft and said second shaft.

8. A system (1) for the production of energy by means of at least one pair of steam turbines (2, 3) operating in cross-compound configuration, in which a first steam turbine (2) is coupled on a first shaft (4) to a first electric generator (6), and a second steam turbine (3) is coupled on a second shaft (5) to a second electric generator (7); and in which the first steam turbine includes just a high-pressure section and a first low-pressure section, whilst the second steam turbine includes just a medium-pressure section and a second low-pressure section; wherein said high-pressure section is connected exclusively to the medium-pressure section, upstream thereof, whilst the medium-pressure section is connected in parallel to said first and second low-pressure sections, immediately upstream thereof, by means of a pipe (18) of a relatively short length that connects the medium-pressure section (14) of the second steam turbine to the second low-pressure section, which is located on the same shaft, and, by means of a branch (20) of said pipe, of a relatively long length, that connects said medium-pressure section (14) with the first low-pressure section, which is located on the shaft of said high-pressure section; wherein said system further comprises a regulation valve (21) that intercepts in series said branch, said regulation valve being placed along said branch as near as possible to said pipe; and in that said low-pressure sections discharge the exhaust steam towards a different condenser respectively.

9. The system according to claim 8, characterized in that it further comprises a single supercritical boiler (22), which supplies in cascaded fashion, said high-pressure section and, then, said medium-pressure section.

* * * * *